United States Patent [19]

Wong

Best Available Copy

[11] 4,296,334

[45] Oct. 20, 1981

[54] PROGRAMMABLE ELECTRONIC STARTING DEVICE FOR AUTOS AND THE LIKE WITH MEANS SELECTABLE TO ACTUATE ACCESSORIES

[76] Inventor: Gim Wong, 1849 Gibbs Rd., Estevan, Saskatchewan, Canada

[21] Appl. No.: 940,357

[22] Filed: Sep. 7, 1978

[51] Int. Cl.[3] ..... F02N 11/08

[52] U.S. Cl. ..... 290/37 R; 290/38 C; 290/DIG. 3

[58] Field of Search ..... 290/38 R, 38 C, 38 D, 290/DIG. 3, 10, 37

[56] References Cited

U.S. PATENT DOCUMENTS

| | | | |
|---|---|---|---|
| 2,748,759 | 6/1956 | Schiffer | 290/38 C X |
| 2,992,335 | 7/1961 | Boucher | 290/38 C |
| 3,043,963 | 7/1962 | Teikari | 290/37 |
| 3,078,834 | 2/1963 | Wright | 290/DIG. 3 |
| 3,130,318 | 4/1964 | Curtis | 290/38 C |
| 3,259,753 | 7/1966 | McWhirter | 290/38 C |
| 3,685,606 | 8/1972 | Blow, Jr. | 290/38 C X |

*Primary Examiner*—B. Dobeck
*Assistant Examiner*—W. E. Duncanson, Jr.
*Attorney, Agent, or Firm*—Stanley G. Ade

[57] ABSTRACT

A programmable electronic 24 hours/7 days timer is operatively connected to various circuits which, in one mode, start or attempt to start the engine at any pre-determined intervals, let it run for a pre-determined time and then switch it off. A thermoswitch arrangement can be incorporated with the timer so that this function may be controlled by temperature rather than timed intervals and can eliminate any day or days, if desired. Further circuitry is provided which enables equipment such as engines, block heaters, interior car warmers, and the like, connected to main voltage, to be switched on and off at pre-determined intervals, if desired.

16 Claims, 5 Drawing Figures

PROGRAMMABLE ELECTRONIC STARTING DEVICE FOR AUTOS AND THE LIKE WITH MEANS SELECTABLE TO ACTUATE ACCESSORIES

BACKGROUND OF THE INVENTION

This invention relates to new and useful improvements in automatic devices for automobiles and the like and constitute an improvement over my U.S. Pat. No: 3,740,564 entitled AUTOMOBILE STARTING DEVICES.

The present device simplifies the operation and as well enables a greater variety of functions to be programmed.

SUMMARY OF THE INVENTION

The present invention incorporates circuitry which, among other things, enables pre-determined time functions to be entered into an electronic programmable timer which, when certain times are reached, will attempt to start the automobile including pumping the throttle to feed gas into the engine and to place the throttle on high idle and which, when the engine starts, will remove the throttle from the high idle position, allow the engine to run for a pre-determined period and then switch off the engine.

Means are provided to permit only a pre-determined number of attempts to start the engine after a resting period in between and which furthermore limits the actual time an individual attempt may continue.

Further means are provided whereby the device may be operated by ambient temperature in the automobile either in hot weather or in cold weather. In the former, when a pre-determined ambient temperature is reached, the car air conditioner may be switched on for a pre-determined period. In the latter condition, and assuming the car is connected to mains voltage, engine block heaters or interior car warmers or any other accessories may be switched on for a pre-determined period.

All of the functions may be operated by simple switches on the face of the instrument as will hereinafter be described and can be programmed to suit the individual circumstances under which the device is being used.

The device is provided with at least two sets of switched or relay contacts in the output circuit, one set being used to indicate the alarm function and the other set of switch or relay contacts may be used to control or turn ON or OFF other electrical equipment or appliances such as block heaters, car warmers at the same or different time settings. Although the present description refers to heating and cooling devices, these are examples only as any form of electrical equipment can be controlled by this device as may be desired.

The display may indicate the number of the key switch that has been actuated and also can display the day location in the 7 day cycle. This lets the operator see exactly what has been programmed into the memory circuit to operate the connected equipment thus eliminating the majority of errors and providing maximum reliability.

A colon (:) in the display unit between the hours and minutes of the time display flashes continuously so that the operator may readily check the electronic clock and see that it is functioning. In the present device, the frequency of flashing is 1 Hz.

Furthermore, means are provided so that the electronic clock timer can be reset or erased readily and easily and re-programming undertaken immediately.

It is preferable that the device operate with battery power from the automobile battery because of the low current consumed by the solid state circuitry and, of course, such solid state circuitry is adapted to operate within a wide range of ambient temperatures.

A monostable multivibrator with a manual trigger circuit may be connected to the decoder driver to turn off the display device automatically at a preset time after the manual trigger switch is depressed. This further reduces power consumption and also prolongs the life of the display device portion.

With the foregoing in view, and other advantages as will become apparent to those skilled in the art to which this invention relates as this specification proceeds, the invention is herein described by reference to the accompanying drawings forming a part hereof, which includes a description of the preferred typical embodiment of the principles of the present invention, in which:

DESCRIPTION OF THE DRAWINGS

In the drawings like characters of reference indicate corresponding parts in the different figures.

DETAILED DESCRIPTION

Proceeding therefore to describe the invention in detail, reference should be made to FIG. 1 in which 20 illustrates a casing or enclosure having one embodiment of a front display panel 21 upon which the various controls and the like are mounted as will hereinafter be described.

Figure 2:
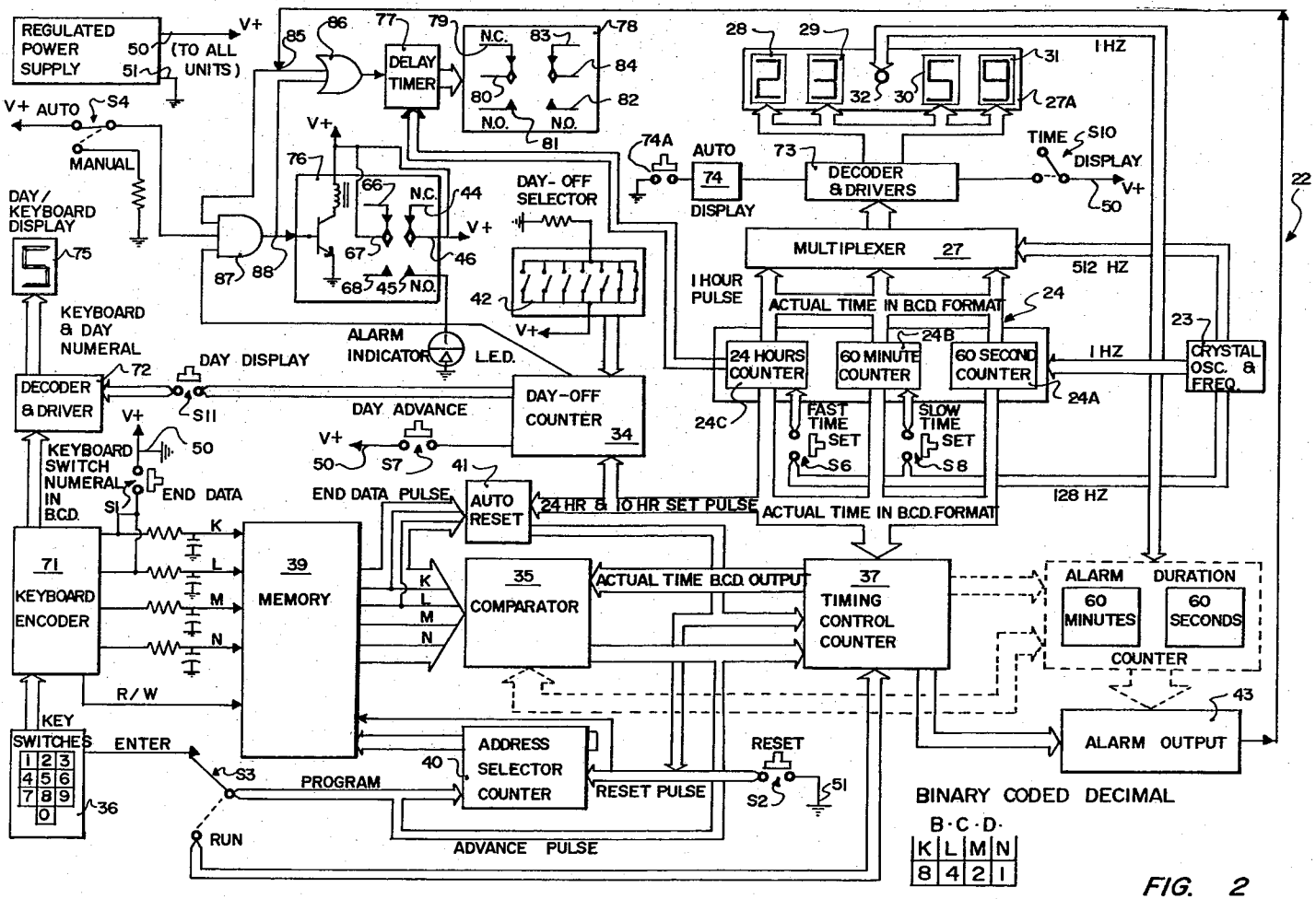
FIG. 2 is a block diagram of one embodiment of the programmable electronic 7-day/24 hours timer.

FIG. 2 shows a block diagram for the electronic clock timer 22 which includes a crystal oscillator circuit 23 which in turn includes a plurality of binary counters (not illustrated) which divide the crystal oscillator frequency down to various frequencies. As an example, frequencies of 1 Hz (one cycle per second) 512 Hz (512 cycles per second) and 128 Hz (128 cycles per second) may be provided. Inasmuch as the internal circuitry of such oscillators and binary counters is well known, it is not believed necessary to give details of the construction thereof.

The 128 Hz frequency signal from the oscillator circuit 23 is utilized to advance a clock 24 fast, through a normally open momentary switch S6 to the 24 hours counter and the 128 Hz signal is also used to advance the clock slow through the normally open momentary switch S8. The fast and slow time setting switches are used to set the clock to the correct time. The 512 Hz signal is used for a display multiplexer circuit 27.

The 1 Hz signal frequency is used to operate the clock circuitry within clock circuits 24 which is conventional. This frequency is further divided down within the clock circuitry to one pulse per minute (1/60 Hz) by the 60 second counter 24A, one pulse per hour (1/3600 Hz) by the 60 minutes counter 24B, and one pulse per 24 hours (1/3600×24 Hz) by the 24 hour counter 24C within the clock circuits 24.

The output information from the clock circuitry within the clock 24 is BCD (Binary Coded Decimal), although other pulse configurations may be used, and one path of the BCD information from the clock 24 is fed to the multiplexer circuits 27 as illustrated. The 2 bit counter within the multiplexer circuit 27 drives the multiplexer circuit which passes each one of the group of 4 BCD words selected in succession at a rate of 512/4 equals 128 Hz. The 4 bits of words then feed to the 7 segment decoder and driver circuits 73 and these are decoded by decoder counters within the decoder and driver circuits 73 which, of course, are conventional, to a 7 segment display unit 27A thus displaying the actual time through LEDs or other similar display devices. Digit 28 show 10's of hours, digit 29 shows unit hours, digit 30 shows 10's of minutes and digit 31 shows unit minutes. The colon 32 is flashed at 1 Hz to indicate readily that the clock is operating.

The device may be provided with a delay timer 77 to operate any accessory electrical appliance or equipment such as engine block heater, etc., which is connected to the output controlled switch means at one or more sets of switch contacts provided therein, in order to turn ON or OFF equipment after a preset time delay.

In this connection, a monostable multivibrator 74 may be provided, if desired, having a manual trigger switch 74A connected as shown in FIG. 2. When activated, this momentary switch 74A triggers the monostable vibrator. The output goes high thus enabling 73 to turn ON the display device 27A after the preset time is reached. As an example, after 10 second, the output of the monostble multivibrator goes low again thus disengaging or disenabling the decoder driver 73. This turns OFF the display device 27A. It will be appreciated that the operation of the monostable multivibrator is conventional.

The day in the 7-day cycle and the memory contents are displayed on the additional display 75. To display the day in the 7-day cycle simply press the day display switch S11 and the memory contents are displayed automatically in correspondence to the keyboard switch 36 which is pressed. The additional display 75 further reduces programming error.

The 1/3600×24 Hz (24 hour pulse) is fed to the Day-Off counter circuit 34 taking the form of a selector counter, which takes 7–24 hour pulses to complete the 7-day cycle.

The other BCD outputs from the clock circuit 24 (the actual time in BCD format) are fed to comparator circuits 35 and are used to compare the time set in the memory circuit by the keyboard switches 36 (see FIG. 1) to the actual time, the timing control counter circuits 37, and the operation or signal duration (alarm) counter circuits 38 (the off time setting), all of which are conventional and are shown schematically in FIG. 2.

Figure 1:
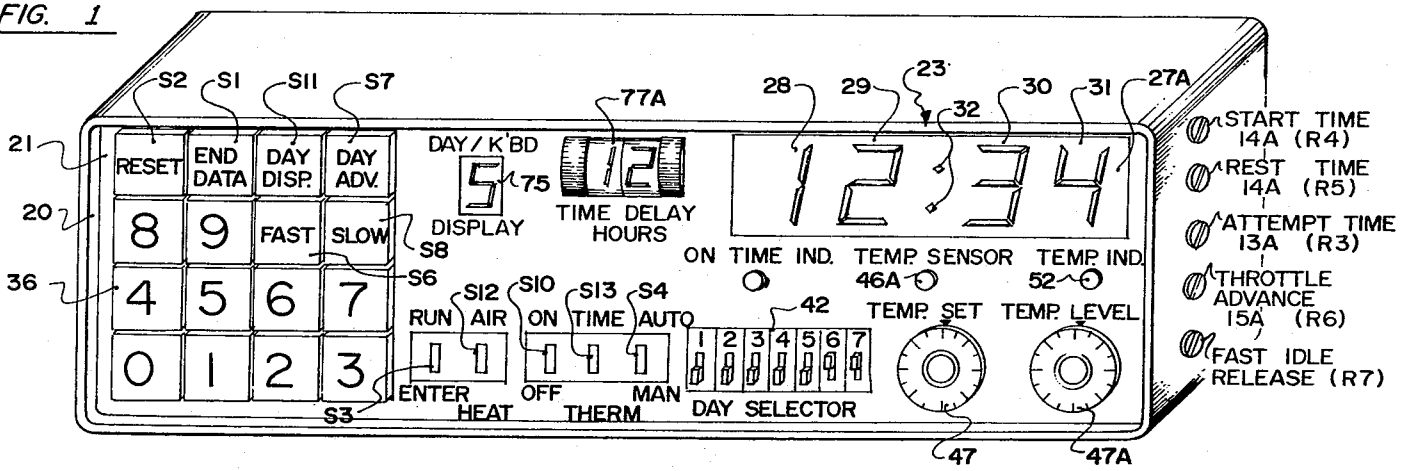
FIG. 1 is a front elevation of the front of the casing or enclosure of the device.

The time selector keyboard 36 consists of 10 momentary operated switches shown in FIGS. 1 and 2 and having indicia thereon which, in the present embodiment, consists of the numerals 0, 1, 2, 3, 4, 5, 6, 7, 8, 9 as illustrated.

The output of the time selector or setting keyboard 36 is converted to Binary Coded Decimal format (BCD) or the equivalent, by the keyboard encoder circuits 71 to feed a memory circuit 39 on lines K, L, M, N and given below is an example of the Binary Coded Decimal format which may be utilized.

| Keyboard Switch | Binary Coded Decimal (BCD) 8 K | 4 L | 2 M | 1 N | |
|---|---|---|---|---|---|
| 0 | 0 | 0 | 0 | 0 | |
| 1 | 0 | 0 | 0 | 1 | |
| 2 | 0 | 0 | 1 | 0 | |
| 3 | 0 | 0 | 1 | 1 | (0 = Low) |
| 4 | 0 | 1 | 0 | 0 | (1 = High) |
| 5 | 0 | 1 | 0 | 1 | |
| 6 | 0 | 1 | 1 | 0 | |
| 7 | 0 | 1 | 1 | 1 | |
| 8 | 1 | 0 | 0 | 0 | |
| 9 | 1 | 0 | 0 | 1 | |

Within the lines K, L, M, N which extend between the keyboard encoder 71 and the memory 39, is a combination of resistances R and capacitors C on each line thus introducing a slight time delay (the RC time constant) which is used to prevent faulty information from entering the memory circuit if, by chance, the keyboard switches are operated incorrectly or bounced.

When any keyboard switch 36 is pressed or an "end data" switch S1 is closed, two signals are generated, the R/W (read/write) signal which goes low to enable data to be read into the memory circuit, and the count command signal for the address select counter circuit 40 (when the data is programmed in Automatic Address Advance mode with S3 in the "enter" position as shown in FIG. 2).

A memory location is selected by the 8 bit Binary counter used as an address select counter within the address select counter (dual 4 bit Binary counter) circuit 40. Since each alarm or signal setting requires 8–4 bit words (4 bit for ON time setting, and 4 bit for OFF time signal or duration setting), the information entered is as follows (see example below):

Starting time of the alarm or start time (ON time) is indicated by two digits for the hours and two digits for the minutes which equals 4 BCD words or 4 memory locations. Secondly, the alarm or operation duration (OFF time) requires either two digits for hours and two digits for minutes for a long OFF time or alternatively, two digits for minutes and two digits for seconds for a short time duration if required, either of which equals a four BCD words.

The number of alarm or signal time settings (ON time and OFF time) therefore is equal to the number of 4 bit words divided by 8. For example, if RAM I.C. or other memory device (Random Access Memory Integrated Circuits) with 256-4 bit words are used for memory circuit 39, the number of time settings is equal to 256÷8=32 and therefore the maximum number of selectable alarm or signal time setting sequence will be 31, one sequence being reserved for the "end data" setting. Thus 8 addresses are required for each ON and OFF time setting as follows:

| "ON" TIME (start time) | | | | "OFF" TIME (finished time) | | | |
|---|---|---|---|---|---|---|---|
| 10's Hrs. | 1's Hrs. | 10's Min. | 1's Min. | 10's Hrs. | 1's Hrs. | 10's Min. | 1's Min. |
| 0 | 0 | 0 | 0 | 0 | 0 | 0 | 0 |
| 4 bits | | | | + 4 bits | | | |
| = 8 bit BCD | | | | | | | |

EXAMPLE Alarm or Signal Setting

| Program Sequence | ON Time | OFF Time |
|---|---|---|

-continued

| | | |
|---|---|---|
| 1 | 07.30 | 07.52 |
| 2 | 11.48 | 12.03 |
| 3 | 13.12 | 13.45 |
| 4 | 15.43 | 16.00 |
| 5 | | |
| 6 | | |
| ↓ | | |
| 20 | 19.05 | 19.23 |
| 21 | 19.45 | 20.10 |
| ↓ | | |
| 31 | 23.37 | 03.59 |

The above mentioned number of time settings is used as an example only as the number of selectable alarm or signal time setting sequences is dependent on the size of the RAM I.C. or other memory device circuits and the number of 8 bit binary counters used for the address selector counter 40 which of course should match the RAM I.C. or other memory device used in the memory circuits. As an example, if a 1024-4 bit word RAM I.C. or other memory device is used for memory circuit 39, the maximum number of selectable signal time setting sequences will be 1024/8=128. By the same token, if a 4096-4 bit word RAM I.C. or other memory device is used, then the number of time setting sequences available will be 4096/8=512 time setting sequences.

The address selector counter used with a RAM memory circuit of 1024-4 bit words would be $2^{10}$ or 10 bit binary counter=1024. In the case of a 4096-4 bit words RAM memory circuit, the address selector counter will be increased to $2^{12}$ or a 12 bit binary counter which provides 4096 addresses to be selected.

A memory location is selected by the 8 bit binary address (dual 4 bit binary counter) counter or the BCD counter within the address selector counter circuit 40 and assuming that the address selector counter 40 is set to 0, by reset switch S2 a program switch S3 is switched to "enter" position as shown in FIG. 2.

To enter data within the circuits, switch S3 on the front panel is moved to the "enter" position, the address advance pulse appears automatically each time a digit on the keyboard switch 36 has been pressed or operated. If an error is made by operating the wrong keyboard switch, then the address selector counter must be reset to 0 location and to erase all of the previous data entered by depressing reset switch S2 whereupon the programming is then started again from the beginning. However, if the wrong keyboard switch is still depressed, to correct this error, simply press the correct key also, then release the wrong key. This will correct the error without having to reprogram all the data into the memory 39 from the beginning.

Reference is made to the previously described conversion from the switches to BCD output by lines K, L, M, and N. As an example, when keyboard switch bearing the indicia 5 is pressed lines L and N are "high" or near positive potential. When switch marked "9" is operated, the output from lines K and N are both high or near positive potential thus transmitting the necessary signal to memory circuit 39. This is accomplished by the gating circuits in the time setting keyboard encoder 71 and is of course conventional.

After all the data has been read in the memory, the "end data" switch S1 is pressed which first causes the R/W line to go low (0) for "write" and then enters data 1100 into memory thus signifying that there is no more data to be read in, because the "end data" switch S1 has entered the word 1100 into lines K, L, M, N which is not a valid BCD character.

After the R/W line has gone high (1) again, 1100 data appears at the "data out" terminals of the memory circuit 39 (due to the gating circuit in the time setting keyboard encoder 71) and resets the address select counter 40 to 0 state, automatically by means of the Auto-Reset circuit 41.

After all of the data of information has been programmed or entered, the end data switch S1 is pressed and S3 switched to "run" position. The electronic timer will operate to turn "ON" and "OFF" equipment connected to the device automatically and corresponding to the time data that has been programmed in the memory circuit 39 and this repeats the program daily until the data in the memory circuit 39 is erased or reset. Needless to say, new data can be re-programmed into the memory circuit 39 in a similar way.

The Auto-Reset circuit 41 consists of a flip flop and age circuits. The 10's hours or 24 hour pulse from the clock 24 hour counter circuit 24 is to set the flip flop and the "end data" signal 1100 from the output of the memory circuit 39 is to reset the flip flop. The output of the flip flop goes high (1) when the 10's hour pulse or both the 10's hour and the "end data" signal appear, and will remain high (1) for a slight time delay controlled by the RC time constant which is provided by the RC network within the Auto-Reset circuit 41 (not illustrated) even after the 10's hour pulse or both the 10's hour and the "end data" signal have been removed. This high (1) output pulse from the flip flop, which is arranged with the following gate circuit within the Auto-Reset circuit 41, to provide a reset pulse to reset both the Address Selector Counter 40 and the Timing Control Counter 37 to its first location (start position) automatically in the 24 hour period and when the "end data" signal appears. It does not have to reach the last memory location before the memory will be recirculated if the operator did not use the full capacity of the memory which is provided.

The timing control circuit 37 consists of, for example:

1. A four stage Johnson octal counter with a built-in code converter (not illustrated). The eight decoded outputs are normally low, and go high only at their appropriate octal time period. The output changes occur on the positive-going edge of the clock pulse and also have carry out output.

2. Tri-state buffer integrated circuits (not illustrated). Its outputs are activated by a low (0) to the tri-state disable input.

3. Quad-2 inputs NOR gates integrated circuits (not illustrated).

The foregoing is an example only as it will be appreciated that other large scale integration circuits, with similar operation and function, can be utilized.

The operation and function of the timing control circuit is as follows:

The actual time in Binary Coded Decimal (BCD) format (the tens of hours, units of hours, tens of minutes, units of minutes) from the clock circuit 24 output is fed to the input of the tri-state buffers. The tens of hours of the tri-state buffers output which is activated by the high (1) from the QO output of the Johnson Counter via a NOR gate, produces a low (0) to the tri-state disable input, so that the tens of hours data appears on the tri-state output which is fed to one input of the comparator circuit 35.

The output of the memory 39 (tens of hours of the first ON time) is fed to the other input of the comparator circuit 35 and compared with the tens of hours from the clock via the tri-state output. When the clock tens of hours becomes equal to the memory contents of the first memory location, the comparator 35 generates a high (1). This advances both the memory address selector counter 40 and the Johnson Counter by one. At this point the Q1 output of the Johnson Counter is high (1) and all the other outputs are low (0), therefore the unit hours are compared with the memory contents of the second memory location. When the unit hours become equal to the actual time of the clock through the tri-state buffers output, the comparator 35 generates a high (1) which advances both the memory address selector counter 40 and the Johnson Counter by one again. Next the tens of minutes, and the unit minutes are compared in a similar fashion, and after four ON time comparisons (tens of hours, unit hours, tens of minutes) are equal to the actual time from the clock through the tri-state buffer output circuits, the Johnson Counter will produce a high (1) on its Q4 output while the carry out or operating output will go low.

A high near positive potential from the alarm output 43, together with a high (1) from the Day-Off counter 34 (with Day-Off selector switches open) and S4 in "auto" position through the AND gate 87, biases the output transistors to a conducting state, thus energizing the relay or conductor or other switch device within the switch device circuit 76, to start the first ON time, which closes the normally open contacts 67, 68, 45 and 46 and opens the normally closed contacts 66, 67, 46 and 44.

The OFF time low (0) output signal from the alarm output circuit 43 also provides a trigger pulse to trigger the programmable timer circuit (commercial available) within the delay timer circuit 77, through the OR gate 86. When the preset OFF time is reached, the output of the delay timer 77 will energize the switch device 78 and will open its normally closed contacts 79, 80 and 83, 84 and close its normally open contacts 80, 81 and 83 and 84 respectively, thus turning ON and OFF electrical equipment connected to the switch contacts 79, 80, 81 and 82, 83 and 84 at the preset delay time set by the RC time constant after the negative going edge of trigger pulse from the alarm output circuit 43 is applied. But if the Auto-Manual switch S4 is in manual position, the output transistors within circuit 76 will not conduct and this will disable the switch device or relay circuit 76, so that the relay contacts within the switch device 76 will remain unchanged as shown in FIG. 2, regardless of the operation of the electronic timer. This means that the thermostat will operate only on the low range temperature selector and electrical equipment connected to the switch contacts 66, 67 and 68 and the equipment connected to the delay timer switches 79, 80, 81 and 82, 83 and 84 will be in normal operation, because the delay timer circuit 77 and the switch device 78 only operate when the output of the OR gate is low (0), or when both the inputs of the OR gates 86 points 85 and 88 are low (0) or ground potential.

The four OFF time comparisons (tens of hours, unit hours, tens of minutes, unit minutes) for the long OFF time setting (or the tens of minutes, unit minutes, tens of second, unit seconds) for the short OFF time in the similar fashion as the ON time comparison. When the four OFF time comparisons agree or are equal to the actual time, then the carry out or operating output of the Johnson Counter will go high. This will cut off the bias to the output transistors in the alarm output circuit 43 and give a low (0) near ground potential signal at point 85. One path of the low (0) signal is applied to one input of OR gate 86 and another path of a low (0) signal is applied to the input of the AND gate 87, and therefore point 88 is also low (0). It is also applied to the other input of the OR gate 86, at this time so that a low (0) signal at the output of the OR gate 86 triggers the delay timer 77 which will energize the relay or other switching device 78, when the preset time delay is reached thus turning ON or OFF any electrical equipment connected to the respective contacts 79, 80, 81 and 83 and 84. The low (0) signal at point 85 will also de-energize the switch device 76 or relay and close the normally closed contacts 66, 67, 44 and 46 and open the normally open contacts 67, 68, 45 and 46 as shown in FIG. 2. The Johnson Counter QO output is high at this time, so that the circuit is ready for the next ON time comparison again. The operation will repeat as above.

When it is desired to program for the short OFF time duration setting by using additional circuits as indicated by the dotted lines in FIG. 2, at the alarm duration counter circuit 38 it can be programmed as shown in the following example.

| | ON Time | | | | OFF Time Duration | | | |
|---|---|---|---|---|---|---|---|---|
| Program Sequence | 10's Hrs. | 1's Hrs. | 10's Min. | 1's Min. | 10's Min. | 1's Min. | 10's Sec. | 1's Sec. |
| 1 | 0 | 7 | 3 | 0 | 2 | 2 | 1 | 2 |
| 2 | 1 | 1 | 4 | 8 | 1 | 5 | 0 | 4 |
| 3 | 1 | 3 | 1 | 2 | 3 | 3 | 4 | 6 |
| 31 | 2 | 3 | 0 | 0 | 5 | 9 | 5 | 9 |

The data is entered to the memory circuit 39 in a similar way as the long OFF time setting in the above example. The 10's of hours from clock are compared with the memory content (K, L, M, N) in the memory location 00, and when they coincide, the comparator circuit 35 produces a (1) which advances the address selector counter circuit 40 by (1) and the Johnson Counter within the timing control circuit 37 also by (1). Next, the unit hours are compared, then the 10's of minutes are next compared, and finally the units of minutes are compared with the memory location 03, in the similar way and when these coincide, the carry out or operating output of the Johnson Counter goes low which resets the timer circuit within the alarm duration counter circuit 38 to zero and also feeds a 1 Hz pulse to start the timer circuit 38 via the NOR gates within the timing control counter circuit 37, depending upon the position setting of the Day-Off counter selector switches in 42.

When alarm signal is generated, i.e. when the carry out or operating output of the Johnson Counter goes low, the alarm duration counter within 38, and the alarm output circuit 43 is high (1) thus energizing the relay circuit within the switch device circuit 76. This opens the normally contacts 44 and 46, and closes the normally open contacts 46, 45 and at the same time starts the alarm duration. When the 10's of minutes of the timer 38 are compared with the contents of the memory location 04, and they are equal, both the address selector counter and the Johnson counter are advance by (1), next, the unit of minutes are compared, then the 10's of seconds are compared, and finally the unit seconds are compared with the memory location 07 and when the unit of seconds are equal to the contents of the memory location 07, the carry out of operating output of the Johnson Counter goes high (1) which is similar to the long OFF time operation. This stops the alarm duration counter timer 38 and when the carry out or operating output of the Johnson Counter goes high (1) this will also de-energize the switch device or relay within the circuit 76, which opens the normally open contacts and closes the normally closed contacts as in the previous example. The Johnson Counter within the timing control circuit 37 will start over again and be ready for the next sequence comparison.

As an example, refer to the previously described time setting 07:35 which is the ON time programmed into the memory. When the actual time on the clock reaches 07:35 as indicated in the display 27A, this signal in BCD format is fed to the comparator circuit 35. This compares the actual time signal with the relevant memory content and because they are now the same, the relay is energized in the switch device circuit 76. This relay remains energized until the actual time on the clock reaches 17:20 (indicated on the display 27A). When this time is reached, the comparator compares this time with the OFF time programmed into the memory 39, and de-energized the relay in the switch device circuit 76. The Johnson Counter within the timing control counter 37 operates and shifts to the next output ready for the next time setting sequence programmed into the memory 39.

When the last program sequence has been executed, the next memory location containing the end data signal 1100 is entered in the Auto-Reset circuit 41 thus resetting the address selector counter circuit 40 and the Johnson Counter within the timing control counter circuits 37 starting location or the first memory location and this repeats the program daily, and starts over again and the system is ready to compare the time setting sequence in the same way.

The Day-Off counter circuit 34 consists of a seven stage binary or ripple counter, one for each day of the week, and the Day-Off selection is accomplished by counting the days with the seven stage ripple counter within the Day-Off counter circuitry 34. A 24 hour pulse received from the clock circuitry 24 advances the day counter by (1) every 24 hours which can be programmed, as an example, by the 7–24 hour pulse to complete the 7 day cycle.

| Monday | Tuesday | Wednesday | Thursday | Friday | Saturday | Sunday |
|---|---|---|---|---|---|---|
| 001 | 010 | 011 | 100 | 101 | 110 | 111 |
| 1 | 2 | 3 | 4 | 5 | 6 | 7 |

The programmed alarm sequence may be disabled for any combination of a day or days in a 7 day cycle by means of closing the switch in the day selector switches 42 on the Day-Off selector keyboard as shown in FIGS. 1 and 2. This shorts out the selected data input in the selector counter within the Day-Off selector counter circuits 34 thus eliminating the operation of the timer in any day or days of the week.

The programmed alarm sequence may also be disabled for any combination of day or days in a one month cycle, by means of added additional single pole single throw day selector switches (not illustrated) instead of 7 single pole single throw switches as used in the 7 day cycle, and by changing feed-back arrangement of the 7 stage binary or ripple counter within the Day-Off counter circuits 34.

Figure 3:
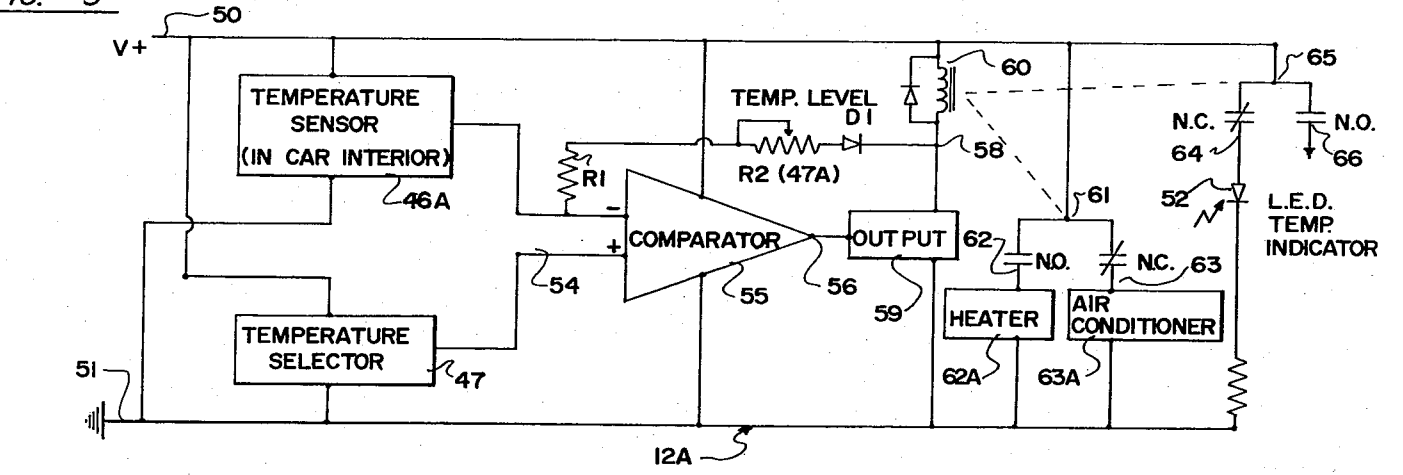
FIG. 3 is a block diagram of one embodiment of the electronic thermoswitch per se.

Reference to FIG. 3 shows a block diagram of the electronic thermoswitch or thermostat unit in which a thermistor or other similar temperature transducer or temperature sensor or temperature controller device is used as the temperature sensing element. The resistance value within the thermistor varies inversely with the temperature so that an increase in the ambient temperature will decrease the resistance value of the thermistor and a decrease in the ambient temperature will increase the resistance value within the thermistor. In other words, the output voltage is directly proportional to the ambient temperature change in degree for some conventional solid state temperature controller devices sold on the mark.

The thermistor and resistors, or the temperature controller device, which are conventional, within the temperature sensor circuit 46A (e.g. sampling the ambient temperature within the car interior), form one leg of a bridge or one of the comparator 55 input. A range temperature selector circuit 47 includes resistors and a linear potentiometer for the temperature selector, form the other leg of the bridge, or the other comparator 55 input.

In the preferred embodiment, the voltage across the temperature selector 47 at the junction 54 forms one leg of the bridge, and the voltage across the thermistor (or other temperature sensor) at the junction 54 which is proportional to the ambient temperature, forms the other leg of the bridge and both feed to the inputs of the comparator circuit 55 which is used to compare both input signal voltages.

When the ambient temperature drops below the temperature set or selected on the temperature selector 47, the output of the comparator circuit goes high at the output 56 and biases an output transistor circuit 59, to a conducting state thus energizing switch device or relay system 60 and closing normally open contacts 66 and 62 to turn ON electrical equipment such as heating equipment connected thereto 62A. At the same time it opens normally closed contacts 63 to turn OFF electrical equipment connected thereto, for example, an air conditioner 63A.

When the switch device or the relay 60 is energized, point 58 goes low but a small amount of current is allowed to flow through an hysteresis or temperature level control (47A) R2, R1 and D1, which is a feedback circuit to control the temperature differential from, for example 1° C. to 20° C. Conventional thermostats include a mechanical adjustment normally operating within a relatively small range such as 3° F., and this means that equipment controlled thereby, cycles ON and OFF to a degree not desirable under present circumstances.

The hysteresis or temperature level control includes a trimmer potentiometer R2 and various resistors in the form of a conventional circuit, which lowers the voltage slightly at the input of the comparator circuit 55, depending upon the value of the resistors and the position of the variable potentiometer R2. This means that the ambient temperature has to vary through a greater range before the switch device or relay 60 is de-energized. For example, if the differential is set to 2° C. then if the ambient temperature rises to 2° C. above the preset high temperature range, the input of the comparator circuit is in balance so that there will be no output pulse from the comparator circuit 56 and the switch device or relay in the output circuit 59 will de-energize thus opening the normally open contacts 66 and 62 to turn off the heating system, and closing the normally closed contacts 63 and 64 to turn on the cooling system and activate the temperature indicator light (L.E.D.) 52.

When the ambient temperature drops down to the temperature set on the selector 47, the relay will again be energized reversing the positions of the contacts, and maintaining the relay in the energized condition until the ambient temperature once again rises slightly above 2° C. above the setting of the temperature selector 47.

The electronic programmable timer 22 can be connected so that it turns ON and turns OFF any internal combustion engine or the like at any pre-determined time or times or at any pre-selected temperature ranges and the operation of the complete device is quite similar to that illustrated and described in my aforementioned U.S. Pat. No. 3,740,564 with the following exceptions:

1. The present device employs a 7-day/24-hour electronic programmable timer and thermoswitch device similar to that illustrated and described in my U.S. Pat. No. 4,079,366 to replace the mechanical 7-day/24-hour timer in U.S. Pat. No. 3,740,564.

2. It replaces the vacuum switch by a relay connecting the relay coil wiring to the alternator stator wiring of the vehicle in order to operate the accessory circuits and the first, second and third timer circuits.

3. The third timer circuit is added to energize and de-energize the solenoid to the throttle linkage in order to advance same so that a charge of gasoline at various time or times may be provided, depending upon the setting of the third timer module. This third timer module also releases the engine "fast idle" after a pre-set running time.

4. It adds a delayed timer module to operate the engine's block heater, interior car warmer or the like at a pre-determined time, if desired. This delay timer module is also shown in the electronic timer and thermoswitch U.S. Pat. No. 4,079,366.

Figure 4:
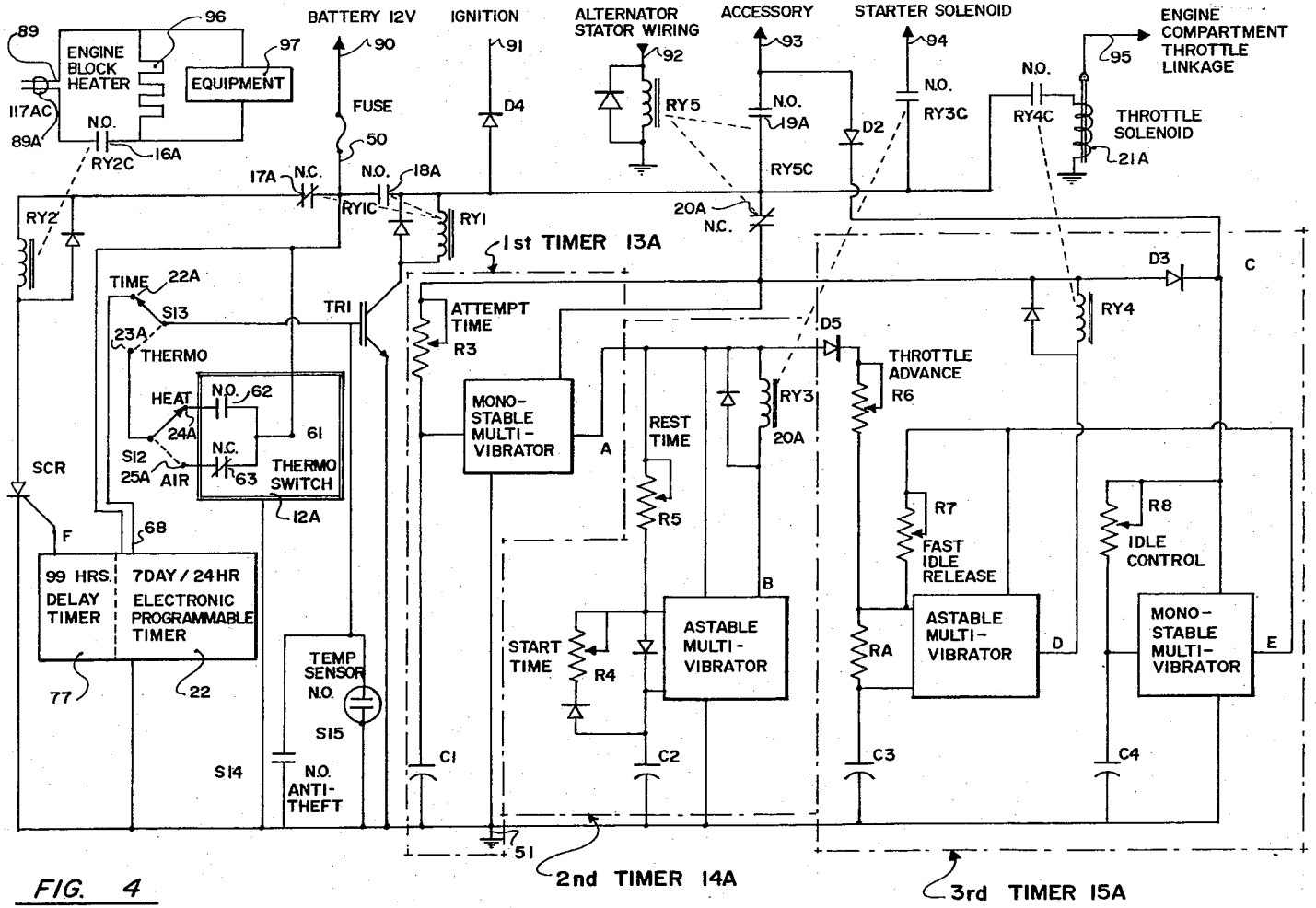
FIG. 4 is a block diagram of one embodiment of the complete device.
Figure 5:
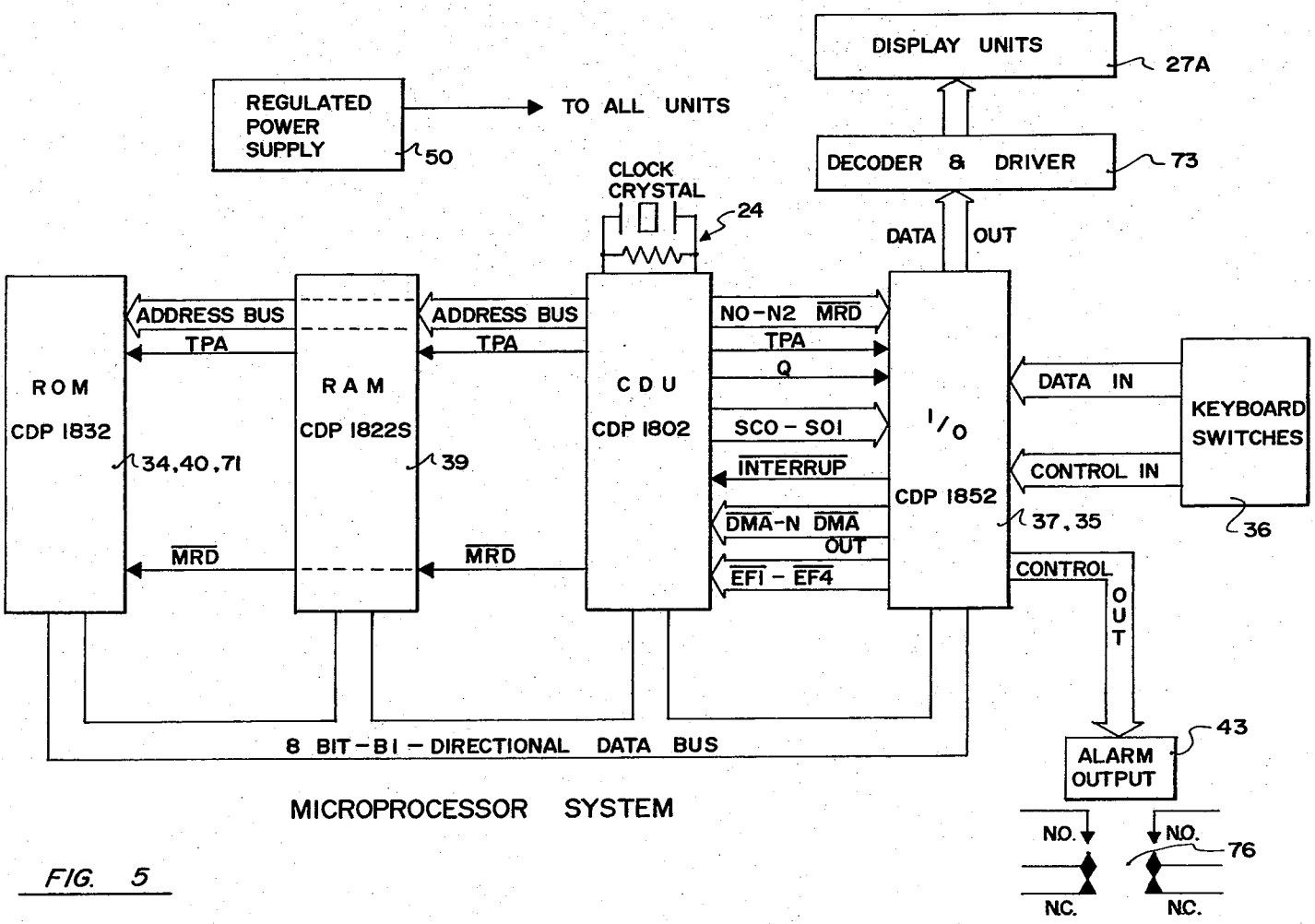
FIG. 5 is a block diagram of the electronic timer portion utilizing a microprocessor.

Reference to FIG. 4 will show various connections of the device not only to mains voltage as indicated by reference character 89, but also to the car battery at 90, to the car ignition circuit at 91, to the alternator stator wiring at 92. The accessories of the car such as the air conditioner, radio or the like may be connected as indicated by reference character 93 and the starter solenoid is connected as indicated by reference character 94. Finally, a throttle solenoid 21A is operatively connected as at 95, to the engine compartment throttle linkage. None of these automotive components are shown as they are conventional.

The mains voltage connection 89 is conventionally 117 V.A.C. and is operatively connected to engine block heaters indicated by reference character 96 and other equipment such as interior car warmers indicated by reference character 97, both of which are conventional equipment on automobiles and the like, particularly those operating in relatively cold climates.

A normally open switch RY2C (16A) is also included in the circuitry from the plug 89A and the equipment 96 and 97 as will hereinafter be described.

Given below is an example of one set of conditions under which the vehicle may be started:

| Engine ON Time | Engine OFF Time |
|---|---|
| 07.45 | 08.08 |
| 11.55 | 12.02 |

-continued

| Engine ON Time | Engine OFF Time |
|---|---|
| 16.15 | 16.30 |

Monday through Friday except Saturday and Sunday and with the starting sequence as follows:

| Start Time | Rest Time | Attempt Time |
|---|---|---|
| 7 seconds | 53 seconds | 4 attempts |

To turn ON the block heater 96 and the interior car warmer 97 at 04.30 every day, and with each starting sequence required to pump the gas pedal twice before attempting to start the engine and to release engine "fast idle" five minutes after the engine starts.

The operator first programs the timer 22 by moving switch S3 to ENTER position, then entering the data into the memory 39 by punching or pressing the relevant time setting keyboard switches 36 to the desired time. (0745, 0808, 1155, 1202, 1615, 1630) and END DATA switch S1 and moving switch S3 to RUN position and then switching the day selector switches 6 and 7 to the OFF position. The first, second and third timers 13A, 14A and 15A are then programmed by adjusting potentiometers R3 to R6 on the side of the casing 20.

The first timer 13A is programmed for four minutes, the second timer 14A for seven seconds ON and fifty-three seconds OFF and the third timer 15A to switch on solenoid 21A for one second and then off (twice repeated), before the second timer is switched on. The third timer energizes the solenoid 21A to advance the throttle once after the engine has been running five minutes, in order to take same off "fast idle". Finally, the delay timer 77 is set for 12 hours thus completing the programme. It will be, of course, understood that these figures are for an example only and any desired sequence may be inserted into the timer 22.

Referring to FIG. 4, when the first ON time (0745) in the memory of the electronic timer 22, coincides with the actual time displayed on the display unit, the output 68 goes high and biases the transistor TR1 to a conducting state. Assuming S13 is in "time" position, indicated in position 22A as shown in the drawing, TR1 will conduct and energize solenoid RY1 thus closing the normally open contact 18A and allowing current to flow from the battery of the automobile, through the ignition circuit (circuits 90 to 91) and also through the normally closed contact 20A to the first timer block 13A.

The output of the first timer 13A at point A goes high and is equal to the supply voltage from the battery thus applying this voltage to the second timer block 14A and also the third timer block 15A as clearly shown in the circuitry. The astable multivibrator circuit within the third timer 15A at point D, switches ON and OFF the solenoid 21A in order to advance the throttle twice before the second timer 14A energizes RY3 and closes the normally open contact RY3C to provide current to switch on the starter solenoid via circuit through 94. This starter solenoid is switched on for seven seconds in order to attempt to start the engine. If the engine fails to start at the first attempt, the output of the second timer 14A at point B, goes high for 53 seconds and then returns to the low point for seven seconds again and repeats the sequence if the engine fails to start, for four attempts. After the fourth attempt, the output A of the monostable vibrator becomes low thus cutting off the power supply voltage to the second timer circuit 14A and to the third timer circuit 15A. This prevents any further attempt to start the engine.

Assuming, however, that the engine started on the first attempt and that the engine is running, the alternator will start to charge and the stator wiring within the alternator induces a voltage through 92, to energize relay RY5 thus opening its normally closed contact 20A in order to cut off the supply voltage to the first timer circuit 13A, second timer circuit 14A and at the same time closing its normally open contact 19A in order to allow current to flow to the accessory circuit via point 93 so that such items as the conventional heater fan (not illustrated) or the air conditioner or radio, etc., (not illustrated) may be operated.

The current also flows through D2 to the third timer circuit 15A at point C. This operates the monostable multivibrator and the astable multivibrator circuits within the third timer circuit 15A. After the pre-set time has been reached, (5 minutes in this example) output D goes low. This will energize RY4 to close the normally open contact RY4C in order to provide current to energize the solenoid 21A for one second and then de-energizes the solenoid. This will advance the throttle and release same in order to release the "fast idle" and allow the engine to run smoothly at "slow idle" speed.

When RY1 is energized, the normally closed contacts 17A are opened and this resets the delay timer circuit 77. It also de-energizes RY2 and opens the normally open contacts 16A in order to cut off power to the engine block heater and interior car warmer, if same are connected to a mains electrical supply.

When the first OFF time is reached (0808) output 68 from the timer 22 drops to zero thus cutting off the biased voltage to transistor TR1 and de-energizing RY1 thereby opening the normally open contacts 18A. This cuts off the voltage to the ignition and the accessory circuits and stops the engine and the accessory circuits.

When the second ON time in the memory circuit coincides with the actual time displayed (1155) RY1 will energize once again and close the normally open contact 18A thus allowing current to flow through the ignition circuit and through the normally closed contact 20A of RY3 and to the first, second and third timer circuits again and the starting sequence will be repeated as above described.

The above sequences have been controlled by the preset electronic programmable timer but if it is desired to start the vehicle by temperature, the thermoswitch 12A is utilized. The operator first switches S13 to the "thermo" position 23A as shown by dotted line and S12 to "heat" position as shown by contacts 24A. This would be used, for example, by a vehicle operating in the winter months or in relatively cold weather. Alternatively, S12 may be switched to "air" at point 25A if the vehicle is being operated in relatively hot weather or in the summer months.

The thermoswitch temperature range selector 47 is set to the desired interior ambient temperature of the vehicle. If it is desired that the interior temperature be maintained say, between 10° C. and 15° C., then the temperature range selector control 47 is set to 10° C. and the temperature level control 47A (R2) to 5° C. When the interior temperature of the vehicle drops to slightly below 10° C., the thermoswitch 12A will close the normally open contact 62 and current flow through S12 and S13 to bias transistor TR1 to conducting state thereby energizing RY1 and closing the normally open contact 18A. Current then flows through the ignition circuit and the first, second and third timer circuits to start the engine at the same sequence as hereinbefore described. When the interior temperature reaches slightly above 15° C., the thermoswitch 12A opens the normally open contact 62 thus cutting off the bias voltage to transistor TR1 and de-energizing RY1 in order to shut down the engine. The thermoswitch used is similar to that illustrated and described in U.S. Pat. No. 3,740,564, but it operates individually and without being connected to the electronic timer alarm output relay contact. It only uses one temperature selector range. The thermoswitch operation to start the engine is also similar to that illustrated and described in U.S. Pat. No. 4,079,366 except that S12 is added for selection between winter and summer operating conditions.

The delay timer 77 within the electronic timer 22 will produce a pulse after the pre-set time is reached (12 hours) after the last OFF timer (1630) and this pulse at F will trigger the SCR to energize RY2 and to close the normally open contact 16A in order to complete the circuit thereby allowing the engine block heater, and interior car warmer to operate provided plug 89A is connected to a source of mains supply, until RY1 is energized and opens the normally closed contact 17A to de-energize RY2 and also reset the delay timer circuit 77 each time RY1 is energized.

If the anti-theft switch S14 or the temperature sensor switch S15 within the vehicle is closed, this shorts the bias voltage of the transistor TR1 to ground and will de-energize RY1 regardless of the state of the "time" or "thermo" is and will stop the engine automatically. This prevents the vehicle from being stolen and prevents damage occurring to the engine is the engine is overheated. The anti-theft switch S14 is the ignition key switch for most of the late model vehicles with locked steering and if the vehicle is not provided with locked steering, then a switch is easily installed in the transmission so that the switch S14 is open only when the transmission is in the "park" position. The temperature sensor S15 is also standard equipment within conventional automobiles.

Dealing next with a brief description of the timers 13A, 14A and 15A, the first timer 13A is a monostable multivibrator whose output is high (equal to battery voltage) once the initial voltage is applied to its circuit through contact 20A of relay RY5C and after the pre-set time is reached (RC time constant is provided within the circuitry). This pre-set time is the "attempt" time and the output at A goes low thus cutting off the supply voltage to the following circuits 14A and 15A. The RC time constant for 13A, the first timer, can be varied from between 30 to 800 seconds although other range can be used. This is varied by adjusting the potentiometer R3 within the timer circuit 13A and is available on the side of the casing as hereinbefore described.

The second timer 14A is connected as an astable multivibrator and with the time setting also being determined RC time constant, when the supply voltage from output A of the first timer 13A is applied. The output B of timer 14A then goes high (near battery voltage) for a pre-set time, said time being adjusted by potentiometer R5 within the circuit, once again available on the side of the casing. This is the rest time setting, namely 53 seconds as per the above example. The rest time setting can be varied by potentiometer R5 from between 4 to 90 seconds, if desired and this time delay allows the throttle advance to advance or give a charge or charges of gasoline injected into the carburetor of the vehicle. In the case of a diesel engine vehicle, this time period will allow the heater element to be turned ON instead of advancing the throttle for the gasoline engine.

After the pre-set time is reached (53 seconds), the output of the second timer goes low and this energizes relay RY3 and closes its normal open contact RY3C in order to attempt to start the engine for the pre-set length of time (7 seconds) in the present example.

After this pre-set time of 7 seconds has passed, and assuming the engine has not started, the output B once again goes high for 53 seconds so that if the engine has not started after the pre-set time is reached (4 minutes or 4 attempts) then the output of the first timer 13A at point A goes low thus cutting off the supply of voltage to the second timer 14A and preventing any further attempts to start the engine thus eliminating any danger of running down the battery or causing damage to the vehicle.

The RC time constant of the start time setting can be varied in this example from between 3 seconds to 60 seconds, if desired, by adjusting potentiometer R4 within the second timer 14A. This potentiometer R4 is also available on the side of the casing.

The other current path from 20A, the normally closed contact of RY5C, also supplies voltage to the third timer circuit 15A. The third timer circuit 15A is a dual timer with half of the timer being connected as an astable multivibrator so that the output D goes high for a pre-set time by the RC time constant adjusted by potentiometers R6 and R7 within the circuit 15A. These again are available on the side of the casing. These potentiometers R6 and R7 control the throttle advance and "fast idle" release time. The RC time constant for the throttle advance can be varied from 2 seconds to 95 seconds in this example, and the "fast idle" release can be varied from 120 seconds to 400 seconds, also in this example. When the output of the first timer 13A goes high, capacitor C3 starts to charge through D5 through the advance potentiometer R6 and resistor RA, and when the pre-set time is reached, output D goes low, RY4 is energized and closes the normally open contact RY4C. This energizes the throttle solenoid 21A to advance the throttle in order to pump gasoline into the carburetor (not illustrated). After one second, the RC time constant RA C3 and output point D goes high against thus de-energizing RY4 and opens the normally open contact RY4C and disconnects current through the throttle solenoid. This continues for the required number of throttle advances necessary.

When the engine is running, the alternator (not illustrated) within the vehicle starts to charge and a voltage from the start wiring within the alternator entering the circuitry at 92, energizes RY5. This opens the normally closed contact 20A thus cutting off the voltage supply to circits first timer 13A, second timer 14A and D5, etc. It also closes the normally open contact 19A to operate the accessory circuits such as the heater fan, air conditioner, radio, etc. The current flows through D2 to the third timer circuit and the output of the monostable multivibrator point E goes high (near to battery voltage) in order to supply voltage to the other half of the third timer, namely the astable multivibrator circuit. This time condensor C3 takes the charge through the "fast idle" release potentiometer R7 and when the preset time is reached (5 minutes in the present example), the astable multivibrator is triggered and output atD goes low thereby energizing RY4 and closing the normally open contact RY4C. This energizes the throttle solenoid to advance or pump the gas pedal once in order to release the engine "fast idle" speed thereby allowing the engine to run smoothly at low speed. After the preset time is reached, the output of monostable multivibrator E goes low thus cutting off the voltage supply to the astable multivibrator circuit in order to prevent the throttle solenoid from continuing to advance the gas pedal.

The delay timer 77 is a programmable "divide by N" BCD counter and the delay time selector thumb wheel switches 77A are available on the front panel of the casing. The hour pulse from the clock circuit 24 in FIG. 2 is fed to the input of the timer and this hour pulse or pulses divide by the delay timing hour or hours as selected by the thumb wheel switch or switches 77A. The minimum time delay is one hour and the maximum time delay is 99 hours simply by dialling the desired number or numbers for the desired delay, after the last engine OFF time. As in the above example, if the operator wishes to turn ON the engine block heater or other equipment at 4:30 A.M. the next morning, then the operator simply dials the thumb wheel switches 77A on the front panel to 12 so that after 12 hours after the last engine OFF time, 1630 or after the 12 hour pulse from the clock 24 in FIG. 2 is applied to the programmable divider 77, the output of the delay timer 77 at F triggers the SCR and thereby energizes RY2 and closes the normally open contact RY2C (16A) in order to turn ON the engine block heater or other equipment at the predetermined time.

When RY1 is energized by the timer or by the thermoswitch opening the normally closed contact 17A, the voltage to the SCR circuit is cut off thereby de-energizing RY2 and opening the normally open contact 16A thus turning OFF the engine block heater and any other equipment in this circuit as previously mentioned, in order to save energy.

The anti-theft switch S14 and the temperature sensor S15 are normally standard equipment within the vehicle as hereinbefore described, with the anti-theft switch being normally in the ignition switch and the steering column lock. If vehicles without this switch are controlled by the present device then a microswitch can be installed on the transmission "park" gear so that the switch is normally in the open position as shown in FIG. 4, otherwise it is closed.

The temperature sensor switch is also standard and is mounted on the engine block for the temperature gauge or temperature indicator. This is normally open unless the engine is overheated at which time it will close. When this switch is closed, it will short the bias voltage and de-energize RY1 thus cutting off current to the ignition circuit and accessory circuit and any other circuits regardless of the time setting and temperature setting of the thermoswitch. This prevents the engine running and being stolen, or prevents the engine being damaged if the engine is overheated.

What I claim as my invention is:

1. A programmable electronic starter device for the engines of vehicles and the like which include a source of electric power, throttle linkage, a starter solenoid and other electrical auxiliary equipment, comprising in combination an electronic timer, a time display device operatively connected to said electronic timer, a time setting keyboard for producing pulses, a memory unit, means operatively connecting said memory unit to said time setting keyboard for injection "ON" time and "off time" within said memory unit, thereby controlling the duration time of the operation of the engine said means including an encoder to translate said pulse into electrical impulses, an address selector counter operatively connected to said keyboard, means whereby each pulse from said keyboard operates said address selector counter, said address counter being operatively connected to said memory unit, a comparator module operatively connected to said memory unit and to said address selector counter and a duration counter operatively connected to said comparator module, an alarm output module operatively connected to said alarm duration counter and timer means operatively connected between said alarm output module and said throttle linkage, said starter solenoid and said other auxiliary electrical equipment to operate same selectively.

2. The device according to claim 1 which includes a temperature sensor in said automobile and the like, operatively connected to said starter device to operate same when the temperature within said automobile and the like falls to a predetermined level.

3. The device according to claim 1 which includes heater means and air conditioning means within said automobile and the like, operatively connected to said starter device.

4. The device according to claim 2 which includes temperature selector means within said circuit operatively connected to said comparator, to preset the temperature which said temperature sensor is operatively connected to said starter device.

5. An automatic starting device for engines of vehicles which include a source of electric power, throttle linkage operating a throttle, said throttle including high and low idling positions, a starter solenoid and other auxiliary electrical equipment comprising in combination a programmable electronic timer, a time setting keyboard for producing pulses, said timer being operatively connected to a plurality of circuits which, in one mode, operatively connects said source of electric power to said starter solenoid at predetermined intervals and which disconnects said circuits from said starter solenoid after a predetermined time and means to operate said throttle to pump fuel to said engine, and further means to place said throttle in the high idling position prior to starting said engine and into the low idling position after starting said engine, said circuit including means to operatively connect and disconnect auxiliary electrical equipment within said automobile and the like, at predetermined timed intervals.

6. The device according to claim 5 which includes thermoswitch means operatively connected to said timer whereby said starter device operatively responds to ambient temperature.

7. The device according to claim 1 in which said circuit includes means to operatively connect and disconnect auxiliary electrical equipment within said automobile and the like, at predetermined timed intervals.

8. The device according to claim 1 which includes means operatively connected to said memory unit to set and control the operation of said device at any predetermined time in any seven-day period.

9. The device according to claim 5 which includes means operatively connected to said memory unit to set and control the operation of said device at any predetermined time in any seven-day period.

10. The device according to claim 5 which includes a normally open temperature sensing means in the engine of the automobile, operatively connected to said device, said sensing means disabling said device when the temperature of said engine reaches a predetermined level.

11. The device according to claim 1, 2 or 3 which includes means in said time setting keyboard for presetting a plurality of starting sequences and the off times of said sequences, said last mentioned means being operatively connected to said memory unit.

12. The device according to claim 4, 5 or 6 which includes means in said time setting keyboard for presetting a plurality of starting sequences and the off times of said sequences, said last mentioned means being operatively connected to said memory unit.

13. The device according to claims 7, 8 or 9 which includes means in said time setting keyboard for presetting a plurality of starting sequences and the off times of said sequences, said last mentioned means being operatively connected to said memory unit.

14. The device according to claim 10 which includes means in said time setting keyboard for presetting a plurality of starting sequences and the off times of said sequences, said last mentioned means being operatively connected to said memory unit.

15. The device according to claims 2, 3 or 4 which includes means operatively connected to said memory unit to set and control the operation of said dlevice at any predetermined time in any seven-day period.

16. The device according to claims 6 or 7 which includes means operatively connected to said memory unit to set and control the operation of said device at any predetermined time in any seven-day period.

* * * * *